US011134763B2

(12) United States Patent
Hippe

(10) Patent No.: US 11,134,763 B2
(45) Date of Patent: Oct. 5, 2021

(54) PORTABLE JEWELRY ORGANIZER

(71) Applicant: Amanda Marie Hippe, Oakland, CA (US)

(72) Inventor: Amanda Marie Hippe, Oakland, CA (US)

( * ) Notice: Subject to any disclaimer, the term of this patent is extended or adjusted under 35 U.S.C. 154(b) by 10 days.

(21) Appl. No.: 16/751,133

(22) Filed: Jan. 23, 2020

(65) Prior Publication Data

US 2020/0229565 A1 Jul. 23, 2020

Related U.S. Application Data

(60) Provisional application No. 62/795,751, filed on Jan. 23, 2019.

(51) Int. Cl.
*A45C 11/16* (2006.01)

(52) U.S. Cl.
CPC ..... *A45C 11/16* (2013.01)

(58) Field of Classification Search
CPC ..... A45C 11/16; A45C 13/001; B65D 25/107; B65D 85/24; B65D 73/0014; B65D 5/4208; A47F 7/02; B65H 75/06
See application file for complete search history.

(56) References Cited

U.S. PATENT DOCUMENTS 3,858,719 A * 1/1975 Isaacs ..... B65H 75/285 206/49
3,899,078 A * 8/1975 Ambrozetes ..... B65D 85/18 206/335
4,034,850 A * 7/1977 Mandel ..... A61B 17/06138 206/63.3
4,811,843 A * 3/1989 Stribiak ..... B23Q 13/00 134/201
5,273,154 A * 12/1993 Braun ..... A45C 11/16 206/495
5,421,457 A * 6/1995 Listenberger ..... B65D 85/04 174/50
5,588,315 A * 12/1996 Holmgren ..... A47F 7/0246 206/1.5
5,641,061 A * 6/1997 de Muylder-Braun ... A47F 7/02 206/564
D400,104 S * 10/1998 Ash ..... D9/457
6,186,737 B1 * 2/2001 Cohen ..... B65H 54/68 206/303
6,227,365 B1 * 5/2001 Gary ..... B65D 73/0064 206/340
6,422,384 B1 * 7/2002 Roederer ..... A45C 11/16 206/566
2005/0045512 A1 * 3/2005 Carroll, Jr. ..... B65D 81/05 206/454
2016/0141774 A1 * 5/2016 Boutin ..... H01R 11/11 439/518

(Continued)

*Primary Examiner* — J. Gregory Pickett
*Assistant Examiner* — Abigail Elizabeth Guidry
(74) *Attorney, Agent, or Firm* — Dunlap Bennett & Ludwig, PLLC

(57) ABSTRACT

A portable jewelry organizer is provided. The portable jewelry organizer has a planar card-like shape. Safety slots are provided along the upper and lower elongated edges of the card-like shape, each slot communicates with a safety well. The safety slots enable users to securely engage the bands and chains of jewelry, preventing the jewelry from becoming self-entangled or tangled with other jewelry.

6 Claims, 3 Drawing Sheets

(56) References Cited

U.S. PATENT DOCUMENTS

| | | | | |
|---|---|---|---|---|
| 2016/0251145 | A1* | 9/2016 | Veret | B65D 5/02 206/335 |
| 2018/0002102 | A1* | 1/2018 | Kelly | B65H 54/68 206/303 |
| 2018/0012435 | A1* | 1/2018 | Finn | A45C 13/001 |

* cited by examiner

PORTABLE JEWELRY ORGANIZER

CROSS-REFERENCE TO RELATED APPLICATION

This application claims the benefit of priority of U.S. provisional application No. 62/795,751, filed 23 Jan. 2019, the contents of which are herein incorporated by reference.

BACKGROUND OF THE INVENTION

The present invention relates to jewelry organizers and, more particularly, to a portable jewelry organizer embodied in a compact card-like device used to keep jewelry untangled and safe during travel.

When travelling with jewelry, owners want to keep their valuables safe and typically organized in one location so that all of their jewelry is readily accessible while safeguarded from being misplaced or lost. Current jewelry organizers, however, are not designed to be taken on the go, and as a result it is not uncommon for such jewelry to become tangled during travel, frustrating the easy-accessibility purpose of organizers.

Specifically, other devices are big bulky jewelry boxes or binder types that are hard to travel with and take a long drawn-out process to put away and store valuables. In short, if a person just wants to store their valuables for say a quick work out, big jewelry boxes are not a viable option.

As can be seen, there is a need for a portable jewelry organizer embodied in a compact device used to keep jewelry untangled and safe during travel. The portable jewelry organizer of the present invention (colloquially known as "UNTGLD") is dimensioned and adapted to fit into smaller transportation devices, while keeping valuables untangled therein. The portable jewelry organizer has card like design, utilizing safe slots where one can wrap their valuables around in order to keep valuables untangled, yet readily accessible.

In short, UNTGLD's sleek, thin-profile design can be used for long extended travel or for quick pitstops, giving users the option for quick and easy untangled storage while still having all the benefits of other jewelry organizers.

SUMMARY OF THE INVENTION

In one aspect of the present invention, a portable jewelry organizer including the following: a card portion that is planar and has opposing first and second working surfaces; the first and second working surfaces are defined longitudinally by an upper edge and a lower edge; a plurality of safety slots are spaced apart along said upper and lower edges, wherein the plurality of safety slots comprise alternating long safety slots and short safety slots, wherein the long safety slots have a length at least one and a half times longer than a length of the short safety slots, and wherein each safety slot communicates the first and second working surfaces; and each safety slots terminates in a safety well having a diameter greater than a width of the safety slot associated therewith.

In another aspect of the present invention, the portable jewelry organizer includes the following: a card portion that is planar and has opposing first and second working surfaces, wherein the card portion has a thickness between 0.5 and 1.0 millimeters; the first and second working surfaces are defined longitudinally by an upper edge and a lower edge; a plurality of safety slots are spaced apart along said upper and lower edges, wherein the plurality of safety slots comprise alternating long safety slots and short safety slots, wherein the long safety slots have a length at least one and a half times longer than a length of the short safety slots; each safety slots terminates in a safety well having a diameter greater than a width of the safety slot associated therewith, wherein each safety slot and safety well is defined by a beveled surface connected to the working surfaces adjacent said safety slot and safety well; an indicative strip interconnects each safety well to one other safety well along the upper edge or lower edge opposing said safety well; and a plurality of pair of post holes inward of the upper edge and the lower edge of the card portion.

In yet another aspect of the present invention, a method of retaining an article with a band so that the band does not become tangled includes the following: providing the above-mentioned portable jewelry organizer; wrapping a central rear portion of the band around the upper edge so that said central rear portion is supported along the first working surface by two spaced apart short safety slots of the plurality of safety slots, wherein a remainder of the band is adjacent the second working surface; sliding two middle portions of said remainder through one long safety slot on the lower edge; and continuingly wrapping said remainder around the first working surface and through the long safety slot between said two spaced apart short safety slots.

These and other features, aspects and advantages of the present invention will become better understood with reference to the following drawings, description and claims.

and

Figure 2:
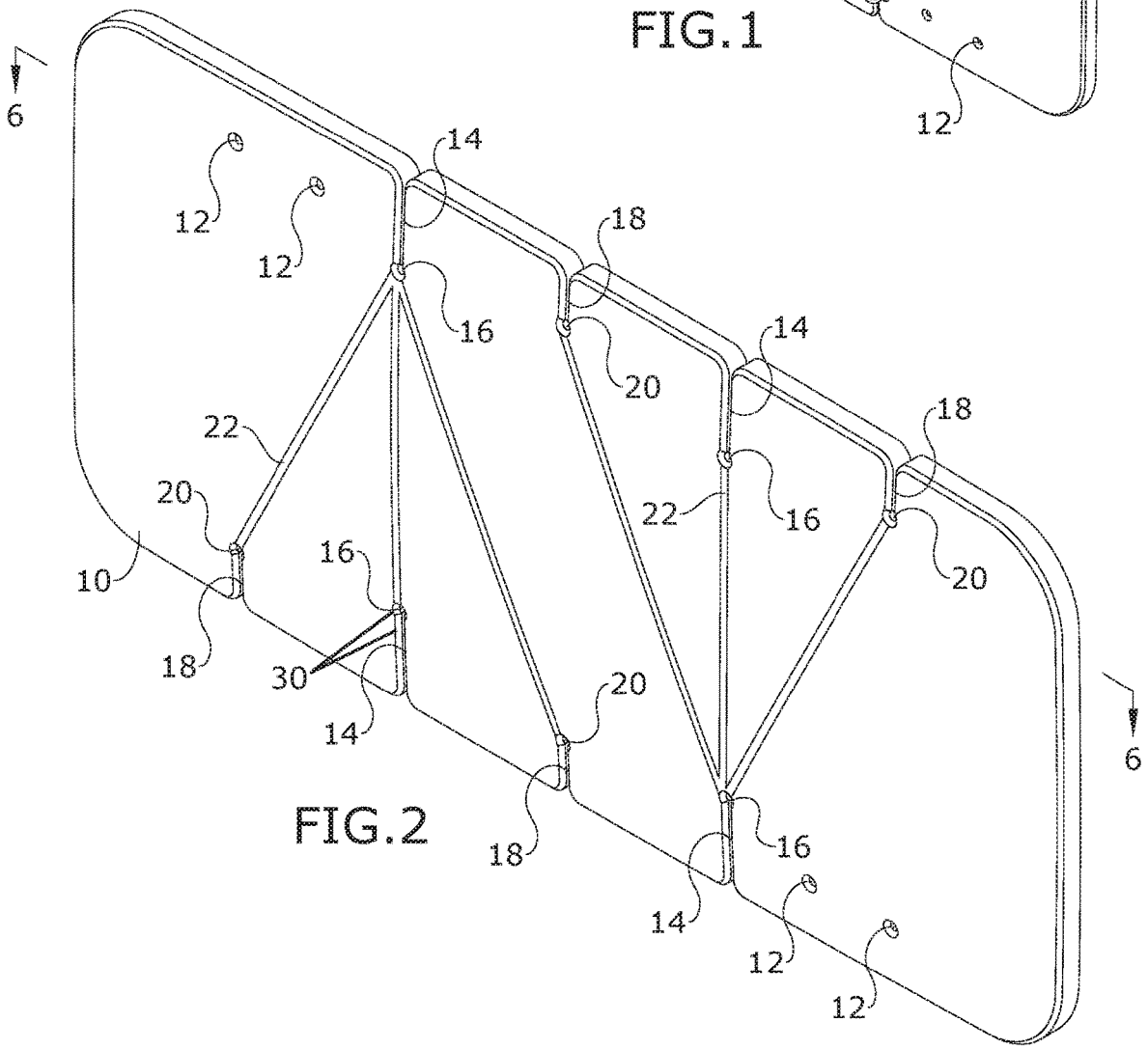
FIG. 2 is a perspective view of an exemplary embodiment of the present invention.
Figure 6:
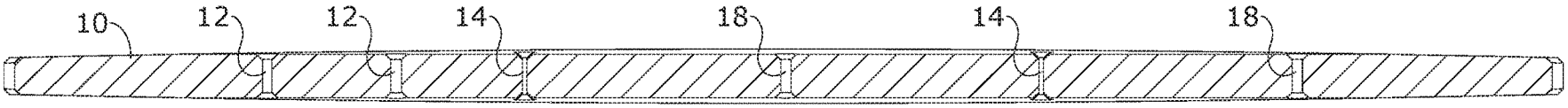

FIG. 6 is a section view of an exemplary embodiment of the present invention; taken along line 6-6 of FIG. 2.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable jewelry organizer having a planar card-like shape where safety slots are provided along the upper and lower elongated edges. The safety slots enable users to securely engage the bands and chains of jewelry, preventing the jewelry from becoming self-entangled or tangled with other jewelry.

It should be understood by those skilled in the art that the use of directional terms such as upper, lower, upward, downward, top, bottom, and the like are used in relation to the illustrative embodiments as they are depicted in the figures, the upward direction (or upper) being toward the top of the corresponding figures, downward (or lower) direction being toward the bottom of the corresponding figures.

Figure 3:
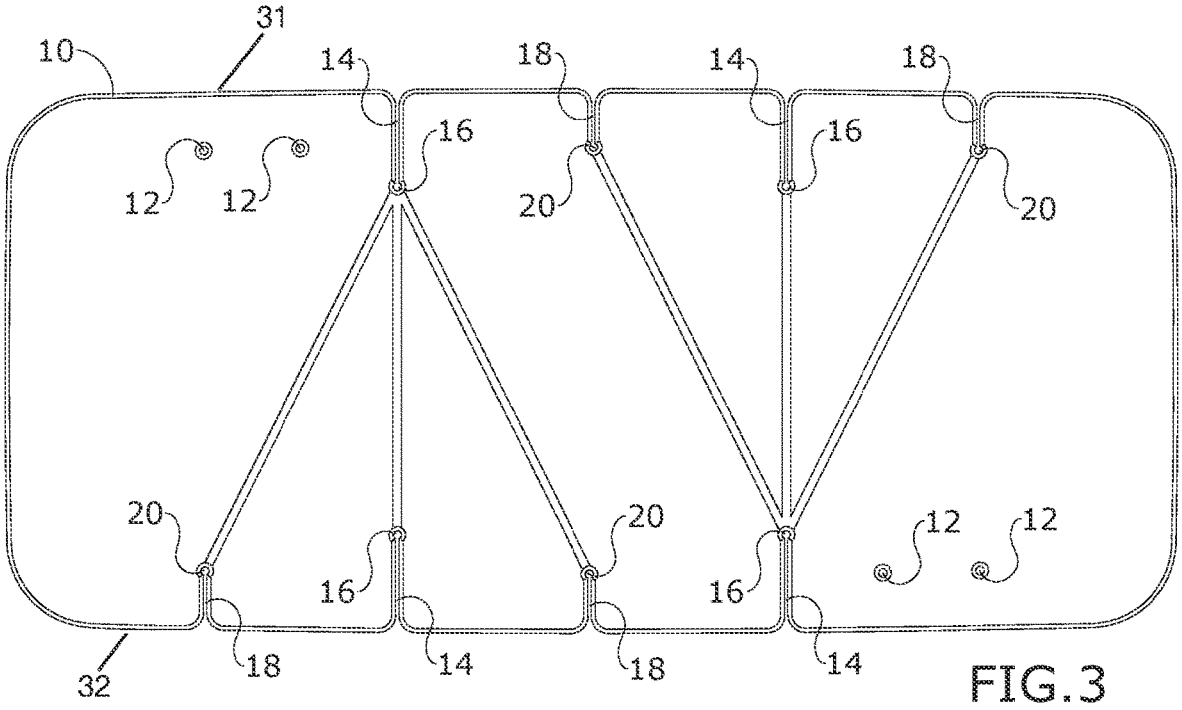
FIG. 3 is a front view of an exemplary embodiment of the present invention.
Figure 4:
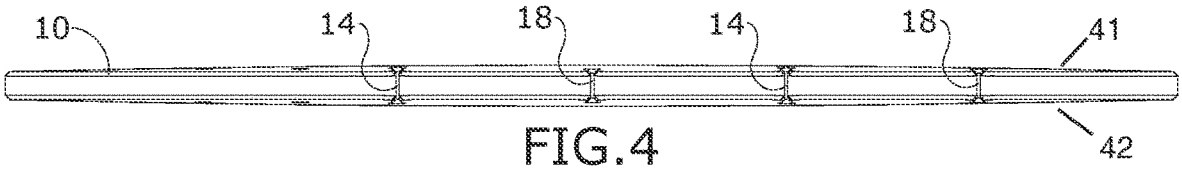
FIG. 4 is a top plan view of an exemplary embodiment of the present invention.
Figure 5:
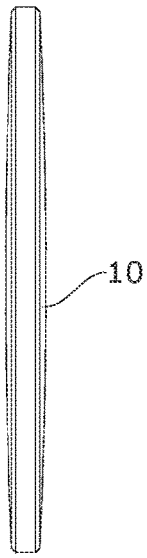
FIG. 5 is a side view of an exemplary embodiment of the present invention.

Referring to FIGS. 1 through 6, the present invention may include a portable jewelry organizer 100. The portable jewelry organizer 100 has a card-like design embodied in a card portion 10 having a first working surface 41 and an opposing second working surface 42, as shown in FIG. 4. The card portion 10 may be a unitary piece of molded silicon, plasticized material, metallic material or the like that is about the size of an average smartphone but the thickness of a credit card, approximately 0.5 to 1.0 millimeter in thickness, and being two to five inches in height and four to six inches in length. The card portion 10 has an upper edge 31 and opposed lower edge 32, as shown in FIG. 3, as well as two opposing side edges.

Inward of the edges may be pairs of post holes 12 (communicating the first and second working surfaces) for removably connecting non-banded jewelry 24, such as earrings, having independent clasp-like fasteners for operatively securing to the post holes 12.

Along the upper and lower edges, a plurality of spaced apart long safety slots 14 and short slots 18 are defined through both working surfaces, extending inward from said edges. In certain embodiments, the long and short safety slots 14 and 18 are alternatingly spaced apart on each upper and lower edge; for example, from one side edge and progressing to the opposing side edge another would start with a short safety slot 18, then a long safety slot 14, then another short safety slot 18, etc. In certain embodiments, the long safety slot 14 may be the "leading" safety slot. The upper and lower edges may be mirror images of each other in terms of safety slot orientation and spacing. The long and short safety slots 14 and 18 may be 0.4 to 0.6 mm in width. The long safety slot 14 may be eight to sixteen mm in length, while the short safety slot 18 may be four to eight mm in length.

Each long and short safety slot 14 and 18, terminates in and communicates with a circular long or short safety well 16 and 20, respectively. Each such safety well 16 or 20 may have a diameter that is greater than a width of the associated safety slot 14 or 18, respectively. Each slot and safety well may have a beveled surface 30 that interconnects the safety slot or well and adjacent working surfaces of the card portion 10. The beveled surfaces 30 are dimensioned and adapted to prevent snagging of jewelry 24, 26 being placed in or removed from the safety slots.

Indicative strip 22 may interconnect the safety wells 16 and 20 on opposed upper and lower edges, as illustrated in FIG. 2. In certain embodiments, the indicative strips 22 may be formed through beveled surfaces 30 along the working surfaces. The indicative stripes 22 may be used as guidelines informing users how to employ the portable jewelry organizer 100 so as to prevent retained jewelry 24, 26 from becoming self-tangled and/or tangled together. Each safety well 16 and 20 may have a diameter between eight and twelve mm.

Figure 1:
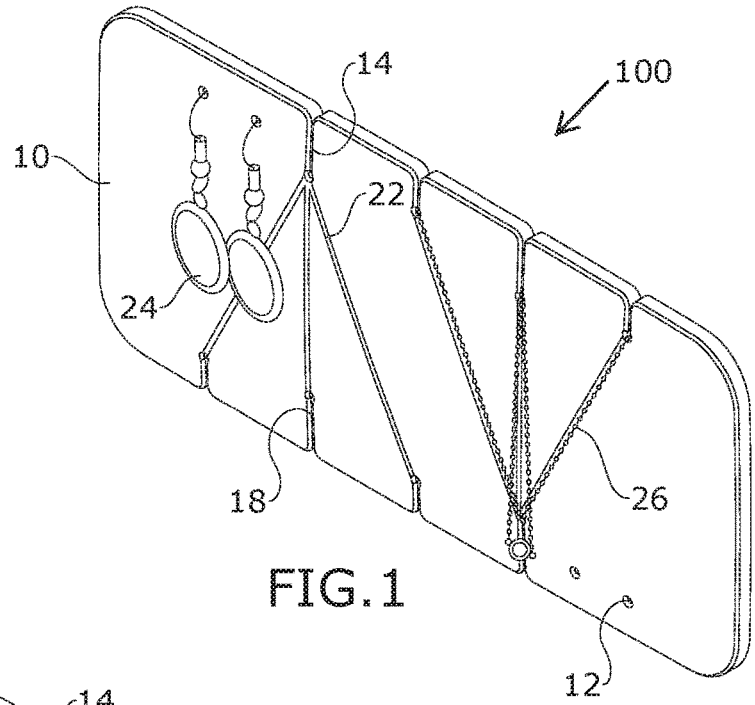
FIG. 1 is a perspective view of an exemplary embodiment of the present invention, shown in use.

To wit, a method of using the present invention may include the following. The portable jewelry organizer 100 disclosed above may be provided. The user may take their band/cord/chain-based jewelry 26, such as a necklace, and wrap the band/cord/chain around the upper and lower edges and through the safety slots and into their associated safety wells 16, 20, in a secured "heart configuration," as illustrated in FIG. 1. The heart configuration involves the following three steps: first, a central rear portion of the band/cord/chain (i.e., the portion of the band/cord/chain that would supportively engage the back of the neck of its wearer) may be slide into two adjacent upper edge short safety slots 18 (with a not-yet engaged 'middle' long safety slot 14 therebetween) so that said central rear portion is supported along/against the first working surface, while the remainder of the band/cord/chain is adjacent to the front of the second working surface; second, of that remainder both middle portions of the band/cord/chain are slid through one long safety slot 14 on the opposing lower edge; and third, then wrapped along the first working surface and through the 'middle' long safety slot 14 back on the upper edge so that the ornamental attachment of the necklace presentably dangles along the second working surface. For guidance, during the formation of the heart configuration, the user may follow the indicative strips 22 through the final two steps.

The long safety slots 14 are better adapted, because of their depth, to receive both middle portions of the band/cord/chain, while the short safety slots 18 aid in the engagement of the band/cord/chain when it is split apart as in the first step.

The user can also store shorter jewelry 24 (earrings) using the post holes 12 in two easy steps. Additionally, the portable jewelry organizer 100 could be used with other components or devices having band/cord/chains, like earphones and headphones, that users want to keep untangled during storage or transport.

It should be understood, of course, that the foregoing relates to exemplary embodiments of the invention and that modifications may be made without departing from the spirit and scope of the invention as set forth in the following claims.

What is claimed is:

1. A portable jewelry organizer, comprising:

a card portion that is planar and has opposing first and second working surfaces;

the first and second working surfaces are defined longitudinally by an upper edge and a lower edge;

a plurality of safety slots are spaced apart along said upper and lower edges, wherein the plurality of safety slots comprise alternating long safety slots and short safety slots, wherein the long safety slots have a length at least one and a half times longer than a length of the short safety slots, and wherein each safety slot communicates the first and second working surfaces;

each safety slots terminates in a safety well having a diameter greater than a width of the safety slot associated therewith; and an indicative strip interconnects two or more safety wells to one other safety well, wherein the indicative strip is defined by a bevel formed into the respective working surface.

2. The portable jewelry organizer of claim 1, wherein each safety slot and safety well is defined by a beveled surface connected to the working surfaces adjacent said safety slot and safety well.

3. The portable jewelry organizer of claim 1, further comprising:

a plurality of pair of post holes inward of the upper edge and the lower edge of the card portion.

4. The portable jewelry organizer of claim 1, wherein the card portion has a thickness between 0.5 and 1.0 millimeters.

5. A portable jewelry organizer, comprising:

a card portion that is planar and has opposing first and second working surfaces, wherein the card portion has a thickness between 0.5 and 1.0 millimeters;

the first and second working surfaces are defined longitudinally by an upper edge and a lower edge;

a plurality of safety slots are spaced apart along said upper and lower edges, wherein the plurality of safety slots comprise alternating long safety slots and short safety slots, wherein the long safety slots have a length at least one and a half times longer than a length of the short safety slots;

each safety slots terminates in a safety well having a diameter greater than a width of the safety slot associated therewith;

an indicative strip interconnects two or more safety wells to one other safety well, wherein the indicative strip is defined by a bevel formed into the respective working surface, wherein each safety slot and safety well is defined by a beveled surface connected to the working surfaces adjacent said safety slot and safety well;

an indicative strip interconnects each safety well to one other safety well along the upper edge or lower edge opposing said safety well; and a plurality of pair of post holes inward of the upper edge and the lower edge of the card portion.

6. A method of retaining an article with a band so that the band does not become tangled, comprising:

providing the portable jewelry organizer of claim 1;

wrapping a central rear portion of the band around the upper edge so that said central rear portion is supported along the first working surface by two of the plurality of safety slots, wherein a remainder of the band is adjacent the second working surface; and sliding two middle portions of said remainder through one of the plurality of safety slots on the lower edge.

* * * * *